United States Patent [19]

Schmitt

[11] 4,300,521

[45] Nov. 17, 1981

[54] COMPOUND BOW

[75] Inventor: Chris Schmitt, Northridge, Calif.

[73] Assignee: Jennings Compound Bow, Inc., Valencia, Calif.

[21] Appl. No.: 123,810

[22] Filed: Feb. 22, 1980

[51] Int. Cl.[3] ..... F41B 5/00

[52] U.S. Cl. ..... 124/23 R

[58] Field of Search ..... 124/23 R, 24 R, 90, 124/86, 25

[56] References Cited

U.S. PATENT DOCUMENTS

| | | | |
|---|---|---|---|
| 4,079,723 | 3/1978 | Darlington | 124/24 R |
| 4,202,316 | 5/1980 | Barna | 124/24 R |

*Primary Examiner*—Richard C. Pinkham
*Assistant Examiner*—William R. Browne
*Attorney, Agent, or Firm*—Charles H. Schwartz; Ellsworth R. Roston

[57] ABSTRACT

A compound bow, including a center handle portion, upper and lower limbs having inner ends connected to the center portion and free outer ends. Upper and lower draw pulleys are eccentrically mounted respectively on axles mounted on the free outer ends of the upper and lower limbs with a first draw cable having one end positioned adjacent the lower draw pulley and extending across the bow and with the other end of the first draw cable extending around the upper draw pulley. A free end of the first draw cable extends tangentially from the outer surface of the upper pulley. A second draw cable has one end positioned adjacent the upper draw pulley and extends across the bow and with the other end of the second draw cable extends around the lower draw pulley and having a free end extending tangentially from the outer surface of the lower pulley. A bowstring interconnects the free ends of the first and second draw cables. A coupling device couples one end of the first draw cable to the free outer end of the lower limb, and a second coupling device couples one end of the second draw cable to the free outer end of the upper limb, and the first and second coupling devices divide the load in the draw cables and couple the load to opposite sides of each draw pulley. Each coupling device is formed of an idler pulley and a short length of cable wrapped around the idler pulley.

11 Claims, 3 Drawing Figures

18
2
14
36
32
28
26
8
2
12
38
40
34
2
4
6
12
28
26
10
34
30
22
16

3
68
18
56
70
58
60
62
52
54
26
50
36
26
32
66
72
14
64
74
28
3

18
56
70
62
50
26
54
66
36
32
64
14
34
74
28

COMPOUND BOW

The present invention relates to an improved compound bow.

Compound bows have a number of advantages over conventional archery bows. Because of these advantages, the use of compound bows has increased and compound bows have been gaining in popularity.

In a conventional bow, the force required to draw the bow is determined by the bow's stiffness and the draw force increases in a relatively uniform manner as the bow is drawn. The fact that the force required to draw the bow increases uniformly imposes limitations on the use of the bow. By way of example, if the bow requires a draw force of 50 pounds the archer must be able to not only draw the bow, but then to hold the bow in a steady position during sighting and discharge of an arrow. While the archer may be able to draw a relatively heavy bow, he may not be able to hold the bow in a steady position during sighting and release of the arrow while maintaining the force on the bow necessary to keep it in its fully drawn position.

In a compound bow, the draw force does not increase in a uniform manner as the bow is drawn. Through the use of eccentrically mounted pulleys positioned at the ends of the bow limbs, the effective length of the bow limbs is increased during draw of the bow through the rotation of the eccentrically mounted pulleys. By the rotation of the eccentrically mounted pulleys, the force required to maintain the bow in a fully drawn position is decreased with the result that the force required to maintain the bow in the fully drawn position during sighting and release of the arrow is less than the maximum force required in drawing the bow. In the case of a bow having a draw weight, for example, of 50 pounds, the maximum force required in drawing the bow is 50 pounds. However, near the end of the draw there is a let-off that can range up to 40% to 50% depending on the size and eccentricity of the draw pulleys. The result of the let-off is that the bow can then be held in a steady position during sighting and release of the arrow with a force of only 25–30 pounds. As the arrow is discharged, the draw pulleys undergo rotational movement which is opposite to the rotational movement that occurs during draw. With the reverse rotational movement of the draw pulleys, the force that is applied to the arrow by the bow is increased, with the result that the arrow is discharged under a propulsive force that is higher than the force required to hold the bow during sighting and discharge of the arrow.

The energy which is stored in an archery bow during draw may be determined by integrating the area under the force draw curve of the bow. In the case of a standard bow, the force draw curve increases continuously upward when the draw force is plotted vertically and the draw distance is plotted horizontally. The force increases continuously upward as the bow is drawn, and with the draw force increasing to a maximum when the bow is fully drawn. However, in a compound bow the force draw curve does not increase continuously upward, but rather is a curve in which the draw force increases rapidly until a maximum is reached and with the draw force then decreasing due to the let-off resulting from the rotation of the eccentrically mounted pulleys. The stored energy which is represented by the area under the force draw curve may be greater for a compound bow than the amount of stored energy for an equivalent standard bow having the same draw length and maximum draw force. The compound bow may, therefore, be more efficient in storing energy during the draw of the bow, so that in order to store the same amount of energy with a standard bow it would be necessary to use a bow with either a greater draw length or a greater maximum draw.

One problem with the general design of compound bows which are currently in use throughout the industry is the result of unbalanced cable loads. Those unbalanced cable loads are inherent in the basic design generally used in the industry. Specifically, the cable loads are unbalanced because the ends of the cables are not attached in a central position at the ends of the limbs and during draw these unbalanced cable loads cause a differential bending or twisting of the bow limbs.

Generally, certain design criteria are normally required for all compound bows. For example, the bowstring should be at or near the center of the limb, and if the bowstring is off center it must be off center to the left for a right-handed bow. This is because a right-handed bow is generally loaded with an arrow from the left side of the bow. Another design criteria is that the load bearing cables must not interfere with the loading of the arrow and the positioning and flight of the arrow when the bow is shot. These design criteria result in a design for the compound bow where the load bearing cables are generally positioned to the right side of the bowstring for a right-handed bow, and with the ends of the cables on the right side of the eccentrically mounted pulley wheel. The positioning of the load bearing cables to the right side provides for the cables to be away from the bowstring.

As the bowstring is drawn, this provides for variations in load in both the load bearing cables and the drawstring, and these variations in load are generally the reverse of each other. This load effect produces a lateral instability in the bow limbs when the bowstring is drawn. The instability is present to a greater or lesser extent and is generally dependent on the relative location of the various load bearing elements along the axles which support the eccentric wheels and the ends of the load bearing cables.

In the prior art there have been attempts to solve this problem of lateral instability, and generally these solutions have included either changes of cross-section of the limb at the limb tip, such as changes in thickness and width, or a lateral displacement of the load bearing elements to the left for a right-handed bow along the axles.

Unfortunately, the two approaches described above ignore the fact that the load difference between the cables and the bowstring vary as the bow is drawn, which load difference results in a variable bias on the limbs throughout the full draw range of the bow. The variable bias depends on the let-off percentages and will vary more or less in proportion to the peak to holding weight relationship.

The present invention provides a solution to the problem outlined above by dividing and redistributing the cable loads along the axis for the eccentric wheel so as to minimize any lateral instability in the bow limbs. Generally, in the present invention a separate yoke structure for each limb effectively divides each cable load and allows the distribution of that load to the axle on both sides of the eccentric wheel. The yoke structure may be provided in a number of different ways, and in the particular embodiment of the present invention the yoke is formed by an idler wheel and a short length of cable. The idler wheel is positioned to have a 90° relationship to the eccentric wheel and with the short cable passing around the idler wheel and with the ends of the short cable coupled to the axle on opposite sides of the eccentric wheel. The end of the load bearing cable is coupled to the yoke by passing through the center of the idler wheel to form a loop. In this way the load in the load bearing cable is divided and distributed to the axle on both sides of the eccentric wheel.

The cable yoke arrangement may be combined with a thin-section eccentric wheel so as to allow for coupling of the ends of the short cable on opposite sides of the eccentric wheel, but as close as possible to the center of the axle. This structure will minimize twisting forces, while at the same time generally maintaining the same overall design for a compound bow as is provided in the prior art. Because the present invention provides for the load bearing cables to be generally in the center of the limb, this tends to bring the string and the load bearing cables closer together. This may create difficulties in the movement of the arrow past the cables as the arrow is released. However, there is currently available a device known as a cable guard. The cable guard is intended to deflect and hold the cables out of the working zone of the bowstring and arrow, and in this way allow for the clear passage of the arrow without interference from the cables. However, since the ends of the cables are supported by the yoke arrangement which divides the force at the end of the cables and distributes the force to both sides of the eccentric wheel, this allows for the minimization of the lateral instability even with the use of a cable guard.

Generally, the present invention provides for a closer positioning to the center of the bow limbs of both the cables and the bowstring. The resistance of the limbs is overcome by a combination of forces applied through the eccentric wheel operating with the cables, and with these forces varying as the load is applied. The use of the eccentric wheel and cables positioned as close as possible to the physical center of the limbs produces the maximum stability in the operation of the bow and the maximum efficiency in the transfer of the stored energy to the arrow.

A clearer understanding of the invention will be had with reference to the following description and drawings wherein.

Figure 1:
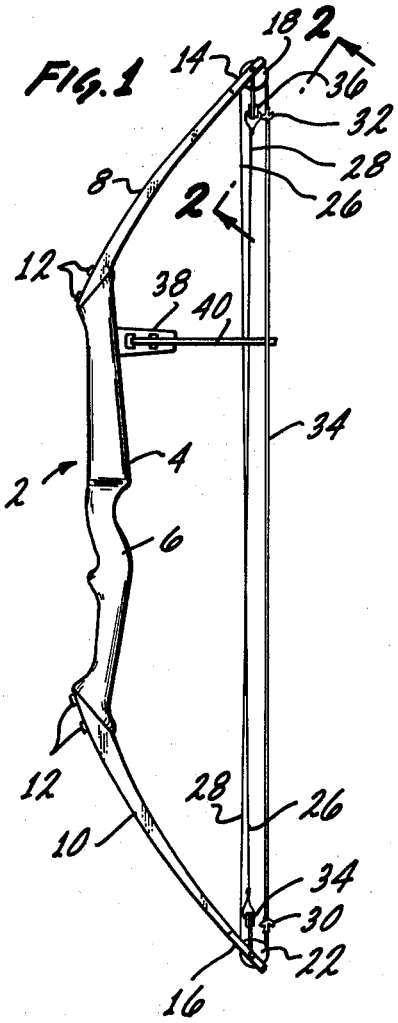
FIG. 1 illustrates a side view of a compound bow constructed in accordance with the teachings of the present invention.

As shown generally in FIG. 1, a compound bow 2 includes a center section 4 having a handle portion 6, an upper limb 8 and a lower limb 10. The limbs 8 and 10 are joined to the center section 4 by any suitable means such as screws 12. An upper end 14 of the limb 8 forms a pulley support section. Similarly a lower end 16 on the lower limb 10 forms a second pulley support section. An upper draw pulley 18 is eccentrically mounted within the upper pulley support section 14, while a lower draw pulley 22 is similarly eccentrically mounted within the lower pulley support section 16.

A draw cable 26 passes over the upper draw pulley 18 while a draw cable 28 similarly passes over the lower draw pulley 22. A bowstring holder 30 is connected to the free outer end of the draw cable 28, while a bowstring holder 32 is connected to the free outer end of draw cable 26. A bowstring 34 has its ends connected to the bowstring holders 30 and 32 and with the bowstring being supported by the draw cables 26 and 28 and the draw pulleys 18 and 22.

The inner ends of the draw cables 26 and 28 are connected within the pulley support sections 14 and 16 using cable yoke structures 34 and 36. These cable yoke structures 34 and 36 will be more fully described with reference to FIGS. 2 and 3. A cable guard 38 is mounted on the center section 4 and includes a rod member 40 which extends past the cables 26 and 28. Specifically, the rod portion 40 of the cable guard 38 engages the cables 26 and 28 and positions these cables to the right for a right-handed bow so as to deflect and hold the cables out of the working zone of the bowstring and arrow.

Figure 2:
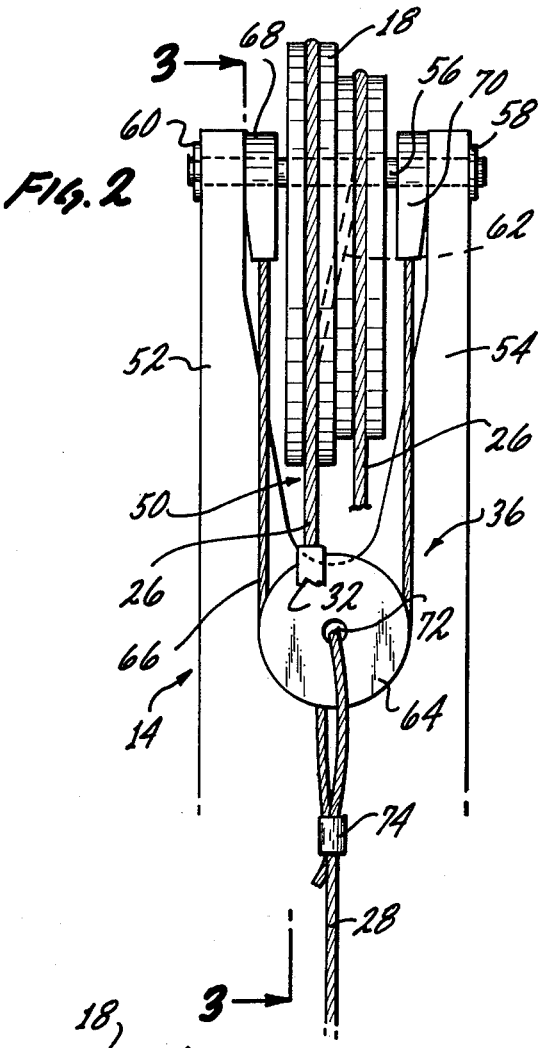
FIG. 2 is a detailed view of one limb end taken along the line 2—2 of FIG. 1.
Figure 3:
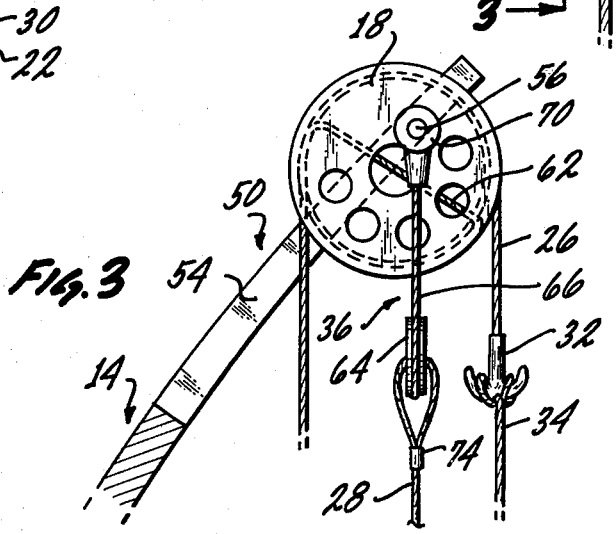
FIG. 3 is a detailed view of one limb end taken along the line 3—3 of FIG. 2.

FIGS. 2 and 3 illustrate in more detail the upper end of the limb 8 which forms the upper pulley support section 14. It is appreciated that the lower pulley support section 16 is substantially identical and the FIGS. 2 and 3 serve as an illustration for both limbs.

In FIGS. 2 and 3 the upper end portion 14 of the limb 8 is shown to be slotted to provide an open area 50 located between two limb tip portions 52 and 54. An axle shaft 56 is supported at the end of the limb tip portions 52 and 54 and passes through and is supported in openings in the limb tip portions 52 and 54. The ends of the axle shaft 56 are held in position by split washers 58 and 60 which are received in grooves in the axle shaft 56. The eccentric pully 18 is mounted for rotation on the axle shaft 56.

The draw cable 26 as shown in FIGS. 2 and 3 passes over one grooved portion of the pulley 18 and crosses internally within the pulley to the other grooved portion of the pulley 18. This is shown in FIGS. 2 and 3 by portion 62 of the draw cable 26. The other draw cable 28 is coupled to the axle shaft 56 through the use of the cable yoke 36.

The cable yoke 36 is formed by an idler pulley 64 and a short length of cable 66 wrapped around the idler pulley 64. The ends of the short length of cable 66 are coupled to the axle shaft 56 using coupling sleeves 68 and 70 which capture the ends. The end of the draw cable 28 is looped through an opening 72 in the idler pulley 64 and with a sleeve member 74 locking the end of the draw cable 28 in position. As can be seen, this yoke arrangement divides and distributes the load in the cable 28 on opposite sides of the eccentric wheel 18 along the axle shaft 56. This yoke coupling considerably reduces the tendency for the limb 8 to twist and also provides for the load to be evenly distributed on both sides of the eccentric wheel 18. Since the limb will not twist, this prevents the pulleys 18 and 64 from being skewed during operation of the bow.

As indicated above, in the prior art the end of the draw cable, such as the cable 28, was coupled to one side of the eccentric wheel 18 and attached to the axle shaft 56. This arrangement would tend to load one side of the wheel, and when so loaded the limb would tend to twist and the entire bow arrangement would become skewed. The present invention therefore provides for an improved compound bow wherein the limbs resist twisting and skewing during operation through the use of a yoke structure to couple the end of the draw cable to both sides of the eccentric wheel and thereby distribute and divide the cable load.

It is to be appreciated that although the application has been described with reference to the yoke structure formed by a pulley and a short length of cable, other structures may be used. For example, the yoke may be formed from a stamped sheet of material or formed out of a U-shaped rod, and with the arms of the yoke relatively rigid as compared to the use of the flexible short length of cable. Since the invention may be subject to adaptation or modification, the invention is only to be limited by the appended claims.

I claim:

1. In a compound bow having a center handle portion, upper and lower limbs having inner ends connected to the center portion and free outer ends, and upper and lower draw pulleys eccentrically mounted respectively on axles mounted on the free outer ends of the upper and lower limbs, the improvement including, a first draw cable having one end positioned adjacent the lower draw pulley and extending across the bow and with the other end of the first draw cable extending tangentially from the outer surface of the upper pulley;

a second draw cable having one end positioned adjacent the upper draw pulley and extending across the bow and the other end of the second draw cable extending around the lower draw pulley and having a free end extending tangentially from the outer surface of the lower pulley;

a bowstring interconnecting the free ends of the first and second draw cables;

first coupling means coupling the one end of the first draw cable to the free outer end of the lower limb;

second coupling means coupling the one end of the second draw cable to the free outer end of the upper limb;

the first and second coupling means each formed as a yoke structure for dividing the load in the draw cables and for coupling the load to opposite sides of each draw pulley, and, wherein each yoke structure is formed by an idler pulley and a short length of cable and with the short cable extending around the idler pulley and with the ends of the short cable coupled to the free outer end of the limb and with the one end of each draw cable coupled to the idler pulley.

2. In the compound bow of claim 1, wherein the ends of the short cables are coupled to the axles on which the draw pulleys are mounted.

3. In the compound bow of claim 1, wherein the draw pulleys are mounted on the axles in the center of the limbs.

4. In the compound bow of claim 3, wherein the ends of the short cables are coupled to the axles on opposite sides of the draw pulleys.

5. In the compound bow of claim 1, wherein the idler pulleys each include a central opening and with the one end of each draw cable coupled to the idler pulley by passing through the central opening to form a loop.

6. A compound bow, including a center handle portion, upper and lower limbs having inner ends connected to the center portion and free outer ends, upper and lower draw pulleys eccentrically mounted respectively on axles mounted on the free outer ends of the upper and lower limbs, a first draw cable having one end positioned adjacent the lower draw pulley and extending across the bow and with the other end of the first draw cable extending around the upper draw pulley and having a free end extending tangentially from the outer surface of the upper pulley, a second draw cable having one end positioned adjacent the upper draw pulley and extending across the bow and with the other end of the second draw cable extending around the lower draw pulley and having a free end extending tangentially from the outer surface of the lower pulley, a bowstring interconnecting the free ends of the first and second draw cables, first coupling means coupling the one end of the first draw cable to the free outer end of the lower limb, second coupling means couping the one end of the second draw cable to the free outer end of the upper limb, the first and second coupling means dividing the load in the draw cables and coupling the load to opposite sides of each draw pulley, wherein the first and second coupling means are each formed as a yoke structure, and wherein each yoke structure is formed by an idler pulley and a short length of cable and with the short cable extending around the idler pulley and with the ends of the short cable coupled to the free outer end of the limb and with the one end of each draw cable coupled to the idler pulley.

7. The compound bow of claim 6 wherein the ends of the short cables are coupled to the axles on which the draw pulleys are mounted.

8. The compound bow of claim 6, wherein the draw pulleys are mounted on the axles in the center of the limbs.

9. The compound bow of claim 8, wherein the ends of the short cables are coupled to the axles on opposite sides of the draw pulleys.

10. The compound bow of claim 6, wherein the idler pulleys each include a central opening and with the one end of each draw cable coupled to the idler pulley by passing through the central pulley to form a loop.

11. The compound bow of claim 6, additionally including a cable guard mounted on the center handle portion and extending to deflect and hold the draw cables away from the bowstring.

* * * * *